US009074293B2

(12) United States Patent
Sung et al.

(10) Patent No.: US 9,074,293 B2
(45) Date of Patent: Jul. 7, 2015

(54) POROUS ELECTROFORMED SHELL FOR PATTERNING AND MANUFACTURING METHOD THEREOF

(75) Inventors: Kie-Moon Sung, Seongnam (KR); Man-Jae Weon, Anseong (KR); Kyung-Ho Lee, Seoul (KR); Young-Min Park, Yongin (KR)

(73) Assignee: MOLTEX CO., LTD., Seoul (KR)

( * ) Notice: Subject to any disclaimer, the term of this patent is extended or adjusted under 35 U.S.C. 154(b) by 742 days.

(21) Appl. No.: 12/845,058

(22) Filed: Jul. 28, 2010

(65) Prior Publication Data

US 2012/0024709 A1 Feb. 2, 2012

(51) Int. Cl.
*C25D 1/10* (2006.01)
*C25D 1/08* (2006.01)

(52) U.S. Cl.
CPC ... *C25D 1/08* (2013.01); *C25D 1/10* (2013.01)

(58) Field of Classification Search
USPC ..... 205/75
See application file for complete search history.

(56) References Cited

U.S. PATENT DOCUMENTS

| | | | | |
|---|---|---|---|---|
| 4,846,938 | A * | 7/1989 | Tazaki et al. | 205/75 |
| 4,964,965 | A * | 10/1990 | Nakatsugawa | 204/280 |
| 5,453,173 | A * | 9/1995 | Oyama | 205/70 |
| 5,728,284 | A * | 3/1998 | Oyama | 205/70 |
| 6,428,647 | B1 * | 8/2002 | Koh et al. | 156/230 |
| 6,849,308 | B1 * | 2/2005 | Speakman et al. | 427/595 |
| 2005/0074671 | A1 * | 4/2005 | Sugiyama et al. | 429/231.95 |

FOREIGN PATENT DOCUMENTS

| | | | | |
|---|---|---|---|---|
| JP | 07-173667 | * | 7/1995 | C25D 1/00 |
| JP | 11-181588 | * | 7/1999 | C25D 1/08 |
| JP | 2010-036358 | * | 2/2010 | B29C 33/38 |

OTHER PUBLICATIONS

Schaper, C.D., "Nanofabrication with Water-Dissolvable Polymer Masks of Polyvinyl Alcohol (PVA): MxL" Emergying Lithographic Technologies VIII, Proceedings of SPIE, 2004, vol. 5374, p. 325-336.*

* cited by examiner

*Primary Examiner* — Keith Hendricks
*Assistant Examiner* — Stefanie S Wittenberg
(74) *Attorney, Agent, or Firm* — Galgano & Associates, PLLC; Thomas M. Galgano; Jessica G. Bower

(57) ABSTRACT

Disclosed are a porous electroformed shell for forming a grain pattern and a manufacturing method thereof. The method includes the step of causing an epoxy mandrel to be conductive by formation of a conductive thin film thereon; transferring a non-conductive masking pattern on the conductive thin film by using a masking film; generating and growing a fine pore at the position of the non-conductive masking pattern through electroforming; and demolding an electrodeposited layer having the fine pore from the epoxy mandrel, Through the disclosed method, precise control, both as a whole or in part, on a diameter, a formation position, and a density of a fine pore can be simply, economically, and efficiently can be carried out according to various curved shapes of the electroformed shell. Accordingly, in forming the surface of a high-quality surface skin material or a plastic molded product with a predetermined pattern, when the fine pore is used as a decompression suction hole or an air vent, a predetermined pattern can be efficiently and economically obtained in such a manner that it has a regular position, a regular directionality, sharp radii, and minimized deformation.

11 Claims, 13 Drawing Sheets

150 Random samples; Avg 0.0998; Std Dev 0.019

- PRIOR ART -

- PRIOR ART -

POROUS ELECTROFORMED SHELL FOR PATTERNING AND MANUFACTURING METHOD THEREOF

BACKGROUND OF THE INVENTION

1. Field of the Invention

The present invention relates to a porous electroformed shell for patterning and a manufacturing method thereof, and more particularly to a porous electroformed shell for patterning and a manufacturing method thereof, allowing to economically and effectively manufacture a surface skin material or plastic molded product with refined texture, which is employed in one-piece molding of a high-quality surface skin material for providing a curved surface of a specific three-dimensional cubic synthetic resin product with refined texture through various patterns of desired shapes and thereby enhancing an emotional quality.

In the manufacturing method of a porous electroformed shell for patterning, according to the present invention, both the overall and local formation positions, densities, and diameters of pores can be simply, economically, efficiently and precisely controlled according to various curved shapes of the electroformed shell by using a masking film. Accordingly, in forming the surface of a high-quality surface skin material (i.e. skin sheet or film) or a plastic molded product with a predetermined pattern, the predetermined pattern can be efficiently formed in such a manner as to have a regular position, a regular directionality, sharp radii, and minimized deformation by using the pores as decompression suction holes or air vents, which may be realized with increased productivity and economical efficiency.

2. Description of the Prior Art

With the improvement of the standard of living, and the industrial development, consumers have recently shown a tendency of gradually considering, as an important purchasing criteria, sensitive qualities (such as colors or textures) shown in a product's appearance as well as the product's own functions.

In accordance with such a tendency, a plastic molding technology and an apparatus thereof have recently been advanced day-by-day. Also, as a cost reduction and a high value addition are required in a vehicle manufacturing field and an information technology (IT) field, various in-mold forming methods and a multicomponents coinjection method have been suggested, and their application ranges have been rapidly expanded.

The in-mold forming method indicates a kind of forming method in which within one mold, various technologies, such as labeling, lamination, painting, coating, welding, surface protection, decoration, assembly, transfer printing, laser cutting, plasma processing, spray activation, or micro-structuring, are applied while a product is molded. Also, the in-mold forming method may be divided into in-mold lamination (IML), in-mold decoration (IMD), in-mold coating (IMC), in-mold transcription (IMT), and the like, according to the kinds of applied techniques.

Meanwhile, in the multicomponents coinjection method, a molded article is manufactured by combining different kinds or colors of polymer molding materials with each other and by using one or more molding machines and a specific molding system through a single process. The method representatively includes sandwich molding, over-molding, or the like.

The two highly-functional and highly-efficient injection molding methods as described above are not independent from each other. In actuality, in many cases, the two methods are mutually overlappingly employed.

In manufacturing interior materials for an automobile, one-piece molding of a high-quality surface skin material is applied to various articles, such as an instrument panel or board, a glove box, a console, a lower cover, a pillar, a door's internal panel, an airbag cover panel, or the like. Also, examples of the method may include: an in-mold injection compression forming method, in which a thermoplastic polyolefin (TPO) film (about 0.7 mm) and a foamed layer (about 3.0 mm) as skin materials of a surface decorative layer for providing grain patterns and soft feeling, and a polypropylene composite as a substrate are used, the preformed TPO skin layer is mounted within a mold by a robot, and foaming and pattern-decorating processes and a molding process are simultaneously carried out as a single process; an in-mold trimming lamination method, in which a skin material after being laser-cut is trimmed within a mold, thereby omitting a post-process trimming process; a post-process-unwanted hybridizing method in which injection molding of thermoplastic resin, and reaction molding of polyurethane are applied to a sheet trim of a premium automobile so as to provide an excellent soft touch effect and a high scratch resistance and a high UV resistance; a carpet surface decoration integral molding method, in which for an interior material of a carpet skin material, a carpet laminate is preformed and compression-molded as a single process, without a preforming process of the carpet skin material, thereby reducing the number of processes; and a multi-stage clamping control injection compression molding method, in which in a case where a skin material is a foam material, the skin material is placed within a mold by opening the mold, and is subjected to low pressure molding, and then the mold is compressed and re-opened to restore the skin material's thickness to be close to its original thickness.

Herein, in in-mold forming employing a skin material having a specific cubic pattern, for example, a natural or artificial leather grain pattern, since the skin material has an influence on an emotional quality, it has become an important issue to provide a predetermined cubic pattern to the skin material, and preform it into a predetermined three-dimensional shape. Examples of such a preforming method may include a positive type (male type) vacuum forming method, a negative type (female type) vacuum forming method, a polyurethane spray method, and a slush molding method.

Herein, a general positive (male) vacuum forming method is shown in FIG. 9. FIG. 9 is a mimetic diagram illustrating a conventional general positive type vacuum forming method for preforming a skin material as a decorative layer. In the method, a sheet 34 made of polyvinyl chloride (PVC) or acrylonitrile-butadiene-styrene (ABS) copolymer, which is pre-textured with a predetermined grain pattern 34*a* and is preheated, is in contact with a porous epoxy mold 30 formed with multiple fine pores 31. Herein, the porous epoxy mold 30 has a specific three-dimensional cubic shape and is supported and fixed by a base 32 formed with a decompression suction hole 33 in the center thereof. Through decompression suction, the sheet 34 formed with the grain pattern is pre-shaped in such a manner that it can correspond to the shape of the porous epoxy mold 30.

This method is advantageous in that productivity and economical efficiency are high. However, since the sheet 34 pre-patterned with the grain pattern 34*a*, in a softened state through pre-heating, comes in contact with the porous epoxy mold 30 having a complicated three-dimensional shape and is vacuum-sucked, there is a disadvantage in that the entire expression precision of grains (sharpness of a grain outline) is low, some grains locally disappear, and positions and directions of grains are irregularly changed.

Meanwhile, FIG. 10 is a mimetic diagram illustrating a conventional general negative type vacuum forming method for preforming a skin material as a decorative layer. In the method, a porous electroformed shell 1' which includes an electrodeposited layer 20 having a grain patterned surface 20*a* and multiple fine pores 21 formed therein is mounted on a lower mold 40 having a decompression suction hole 41 in the center thereof. Then, a smoothened thermoplastic polyolefin (TPO) sheet 35 not formed with a grain pattern is softened through preheating, comes in contact with the porous electroformed shell 1', and is decompression-sucked while pressed by an upper mold 50. As a result, a grain pattern is provided to the sheet and at the same time, the sheet is pre-shaped.

Accordingly, since the above described negative type vacuum forming method generally employs the porous electroformed shell 1', there is an advantage in that the expression precision of grains (sharpness of a grain outline) is high, local disappearance of grains hardly occurs, deformation of grains is minimized, positions and directions of grains are regular, and productivity and economical efficiency are high. Thus, the method has been widely applied to the manufacturing of a skin material having a decorative layer.

Meanwhile, a polyurethane spray method for obtaining a preformed skin material by spraying polyurethane on a grain-patterned surface of a mold, followed by curing, and a slush molding method for obtaining a preformed skin material by heating and rotating a mold embedded with a predetermined amount of thermoplastic polyurethane slush, and coating and curing the melted resin within the front surface (internal surface) of a mold cavity, has an advantage in that the expression precision of grains is high and positions and directions of grains are regular, but has a disadvantage in that the productivity and the economical efficiency are low and the durability of the mold is reduced.

As described above, since in an in-mold forming method employing a skin material with a specific cubic pattern, for example, a grain pattern, the above mentioned negative type vacuum forming method may be applied. Hereinafter, a conventional manufacturing method for the porous electroformed shell 1' to be applied to pre-forming of the skin material, especially, a porous nickel electroformed shell, the porous electroformed shell 1', and a forming method of the skin material, will be described.

Japanese Patent Laid-Open HEI 02-225687 (laid open on 1990.09.07) discloses a method for manufacturing a breathable porous electroformed mold, which includes the steps of: electrostatic planting a short fiber on a silver mirror conductive film of a mandrel surface; forming a first electroformed layer in which the base of the short fiber is buried; layering a second electroformed layer for generating and growing a through hole from the leading end of the short fiber; peeling the first and second electroformed layers from the mandrel; and removing the short fiber. This method requires an additional electrostatic file planting apparatus, two-step electroforming processes controlled according to the length of a short fiber, and a short fiber removing process by combustion and/or solvent dissolution, and thus has a low productivity and a low economical efficiency. Furthermore, since it is difficult to locally control the planting density of a short fiber file (a forming position of a shell hole) in accordance with a three dimensional shape during electroforming, it is also difficult to locally control the hole density of the electroformed shell.

Also, U.S. Pat. No. 5,728,284 (1998.03.17) discloses a method for manufacturing a porous electroformed frame, in which an electroformed frame surface layer with no hole is electroformed; a fine straight hole having a narrow and predetermined diameter is formed by laser, electron beam, ion beam, electric discharge, or drilling; and an enlarged-diametric hole from the end of the fine straight hole is extended by electroforming so that the hole diameter cannot be enlarged even by a long-time surface friction. This method has an advantage in that it is theoretically possible to control the diameter of the fine straight hole and the whole/local density, but has a disadvantage in that physical processing of multiple fine straight holes is very complicated, uneconomic, and time consuming, thus is in actuality, not efficient at all.

SUMMARY OF THE INVENTION

Accordingly, the present invention has been made to solve the above-mentioned problems occurring in the prior art, and a first object of the present invention is to provide a porous electroformed shell for patterning and a manufacturing method thereof, in which diameters, formation positions, and densities of fine pores formed on a three-dimensional electroformed shell, both as a whole or in part, can be simply, economically, efficiently, and precisely controlled according to various curved shapes of the electroformed shell.

Besides the first object, a second object of the present invention is to provide a method for manufacturing a patterning porous electroformed shell, so as to economically and effectively manufacture a surface skin material with refined, sharp, and precise texture, the surface skin material being employed in one-piece molding of a high-quality surface skin material.

Besides the first object, a third object of the present invention is to provide a method for economically and effectively manufacturing a patterning porous electroformed shell so as to effectively express refined, sharp, and precise texture on the surface of an injection molded product.

Besides the above mentioned objects, a fourth object of the present invention is to provide a method for manufacturing a patterning porous electroformed shell, in which a diameter, a formation position, and a density of fine pores can show high reliability and constancy with no influence of a difference in the proficiency of an operator.

Besides the above mentioned objects, a fifth object of the present invention is to provide a method for manufacturing a porous electroformed shell, in which a plurality of porous electroformed shells having high similarity in a diameter, a formation position, and a density of fine pores can be duplicated.

A sixth object of the present invention is to provide a patterning porous electroformed shell manufactured by the manufacturing method according to the first to fifth objects, especially, a patterning porous nickel electroformed shell.

In accordance with an aspect of the present invention, there is provided a method for manufacturing a porous electroformed shell for patterning, the method including: a conductive thin film forming step of forming a conductive thin film on a patterned surface of an epoxy mandrel, and causing the patterned surface to be conductive; a masking pattern transferring step of transferring a non-conductive masking pattern on the conductive thin film by using a masking film formed with the non-conductive masking pattern; an electroforming step of forming an electrodeposited layer by electrodepositing an electroforming metal on the conductive thin film while generating and growing a fine pore at a position of the non-conductive masking pattern; and a porous electroformed shell demolding step of demolding the electrodeposited layer having the fine pore from the epoxy mandrel.

Preferably, the transferring of the masking pattern may be carried out by a wet-transfer masking film, a negative-type photomask film, or a positive-type photomask film.

Preferably, the masking pattern from the masking film may be transferred in a form of multiple dots spaced apart from each other, and also, the dots may be spaced apart from each other, and a dot density defined by a number of the dots per unit area may be wholly uniform or locally non-uniform.

Preferably, in the electroforming step, a blocking film having a height greater than an uppermost height of the epoxy mandrel by 20~200 mm, preferably by 100~200 mm, and multiple pores formed therein may be placed in a box form at front/rear/left/right sides and an upper side of the epoxy mandrel, and may be immersed in an electroforming tank, so as to prevent bubbles from detaching by a flow velocity of an electroforming liquid.

Preferably, the electroforming step, a current may be in stages increased in a range of 0.5 to 2.5 $A/dm^2$ or fixed at a predetermined value within the range.

Preferably, molding of the epoxy mandrel by the silicone cast, and electroforming of the porous electroformed shell from the epoxy mandrel may be repeated at least plural times to form at least a plurality of porous electroformed shells having the same pattern and the same shape.

In accordance with another aspect of the present invention, there is provided a porous nickel electroformed shell for patterning, manufactured by the above described method, wherein the porous nickel electroformed shell has multiple fine pores, in which the fine pores have a front-side opening diameter within a range of 0.02 to 0.35 mm, and a rear-side opening diameter within a range of 1.20 to 3.50 mm, and are formed in such a manner that the fine pores are spaced apart from each other, and a fine pore density defined by a number of the fine pores per unit area is wholly uniform or locally non-uniform.

Preferably, at least 75% of the fine pores, preferably at least 90%, have front-side opening diameters within a range of 0.05 to 0.15 mm.

In the manufacturing method of a patterning porous electroformed shell, according to the present invention, a masking film having a masking pattern is used so that both as a whole or in part, diameters, formation positions, and densities of fine pores can be simply, economically, efficiently, and precisely controlled according to various curved shapes of the electroformed shell. Accordingly, in forming the surface of a high-quality surface skin material (that is, skin sheet or film) or a plastic molded product with a predetermined pattern, when the fine pore is used as a decompression suction hole or an air vent, a predetermined pattern can be efficiently and economically obtained in such a manner that it has a regular position, a regular directionality, sharp radii, and minimized deformation.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE EXEMPLARY EMBODIMENTS

In the present specification, the term "pattern" is widely defined by not only a specific surface shape, but also other shapes recalling any repetitive or specific unificative idea. Especially, the term "grain pattern" is defined by any pattern realized on the outer surface of natural or artificial leather.

Also, the term "shell" denotes a skin-type mold having a three dimensional shaped curve and a protrusion, and sometimes its meaning includes a plate-type two dimensional shape.

Also, the term "porous electroformed shell for patterning" is widely defined by not only a mold for preforming a skin material in a negative type vacuum forming method for manufacturing the skin material used for one-piece molding of a high-quality surface skin material (a kind of in-mold forming method), but also a mold or a screen, used for various forming methods, such as blow molding, stamping molding, injection molding, RIM urethane molding, compression molding, injection compression molding, multi-stage clamping control injection compression molding, various in-mold forming methods, in-mold insert injection molding, resin beads foam molding, and preform molding.

Hereinafter, the present invention will be described in detail with reference to the drawings.

FIGS. 1*a* to 1*j* illustrate in sequence a method for manufacturing a porous electroformed shell for patterning, according to the present invention. Hereinafter, this will be described.

Figure 1A:
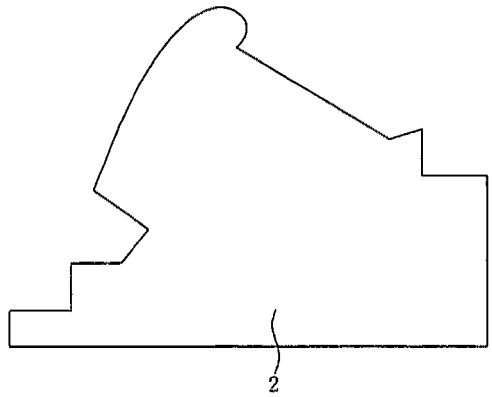
FIGS. 1*a* to 1*j* are views illustrating in sequence a method for manufacturing a porous electroformed shell for patterning, according to the present invention.

First, FIG. 1*a* shows a step of manufacturing a model, in which all data related to a shape and a size of an injection molded product are obtained from a product developing company or a product manufacturing company, the data are analyzed and reviewed, a tool design of the product is carried out, and a model 2 is obtained based on this.

The model 2 is conventionally made of wood, and as required may be made of synthetic resin (such as epoxy, chemical wood, or the like) or other various materials, such as plaster or beeswax. In general, the outer surface of the model 2 is formed as a smooth surface.

The data on the model 2 are modified in such a manner that a precise pattern can be realized in consideration of the shape and size of the product, and size conversion with about 0.1~1.0 mm can be carried out based on experiences and experimental information. Such data modification takes implementation for easy and precise patterning of a molded product, into consideration.

Also, an appropriate thickness is selected so as to provide durability required for the implementation, the product shape is re-designed, and the obtained data are stored. Since the modified data on the re-designed model 2 is directly related to productivity, various reviews are carried out from the stand point of operating directions and angles for mounting and demolding.

Meanwhile, although not shown, in exceptional cases, the model 2 may be made of light metal, such as Fe, Cu or alloys thereof, Al or alloys thereof, Sn or alloys thereof, Ni or alloys thereof. In these cases, the model 2 may be directly patterned without a leather wrapping step shown in FIG. 1*b* as described below. Herein, the roughness of a finished surface is preferably equal to or greater than #600 based on sand paper so as to form a sharp and precise pattern.

As described above, in a case where the model 2 is made of a light metal, and its surface is directly patterned, a predetermined required pattern, such as a natural sensitive environment-friendly pattern image, or an artificial creative image, is used to create a predetermined required design through a known photographing technique, and a known computer application program, and then the created design is combined with any object for expressing the pattern. In general, a photomask film for transferring predetermined patterned features on the outer surface of the model 2 is manufactured. This has a significant influence on the quality of the pattern formed on the molded product.

Accordingly, in a case where the model 2 is made of a light metal, after the determination of a pattern and the manufacture of the photomask film, as described above, the surface of the model 2 is formed with a positive type or negative type photoresist coating film, and attached with a prepared photomask film, followed by UV irradiation, developing, and etching. Through the etching with a depth of about 5 μm to 500 μm, a predetermined pattern with a protrusion and a recess is formed. Such etching may be wet etching or dry etching. Meanwhile, the surface state of the model 2 after the etching has a direct influence on the quality of the pattern, and thus, as required, an additional high gloss surface finishing step or an additional matte surface finishing step may be carried out, in which the method proceeds to a silicone casting step as shown in FIG. 1*c* without the leather wrapping step as described below as shown in FIG. 1*b*.

Figure 1B:
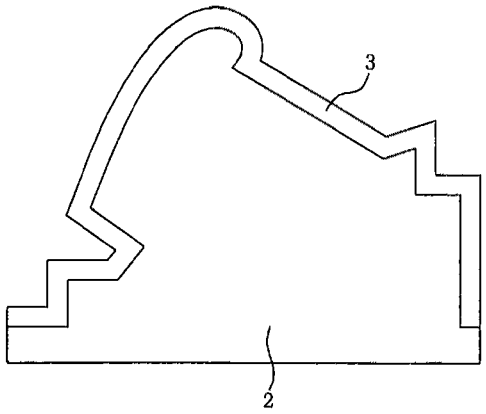

Meanwhile, in a general case where the model 2 is made of wood, synthetic resin, plaster or beeswax, other than a light metal, the leather wrapping step as shown in FIG. 1*b* is carried out. In this step, the outer surface of the model 2 made of wood, or the like, obtained from the step shown in FIG. 1*a*, is wrapped with a leather 3 having a to-be-realized pattern, for example, a specific natural or artificial leather grain pattern, and an adhesive state of the leather 3, a pattern direction, a deformation in grains constituting the pattern, a defect of the grains, an extent of the defect, and the like, are checked.

Figure 1C:
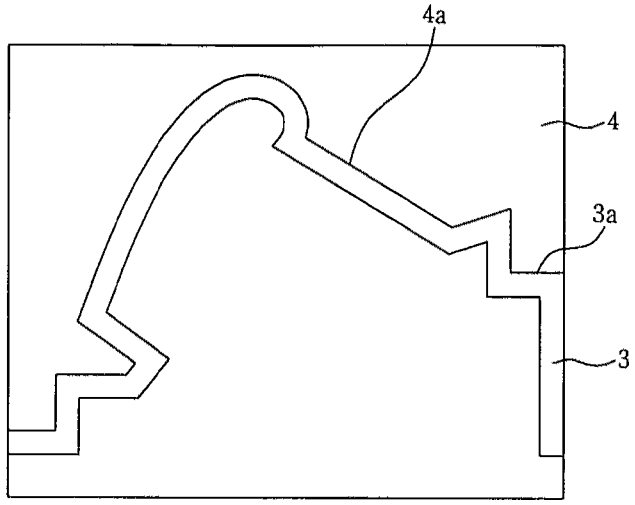

Then, FIG. 1*c* shows a silicone cast manufacturing step for surface transfer of the wrapped model 2 or the patterned light metal model 2. In this step, a silicone resin is applied to the outer surface formed with the pattern, followed by curing, by which the inner surface of a negative-type silicone cast 4 becomes a patterned surface 4*a* by a patterned surface 3*a* of the leather 3 or an etched patterned surface of the light metal model 2.

In general, the silicone resin has a high elasticity, and can be transferred without concern about damage to a formed fine and precise pattern during demolding. The layer of the silicone resin is generally shaped with a predetermined thickness of about 5 to 20 mm, and is cured by settling at room temperature for about 24 to 48 hours.

The resin that may be used in the above described step shown in FIG. 1*c* is not limited to silicone. There is no limitation in the resin as long as it is a soft material having a similar physical property known in the art to that of silicone.

Figure 1D:
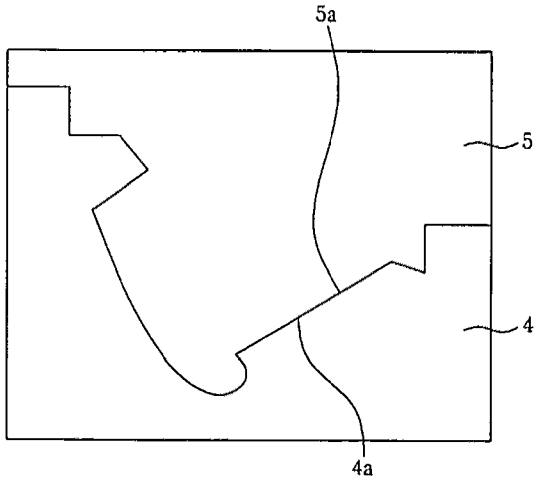

Then, FIG. 1*d* shows a step of manufacturing an epoxy mandrel 5. In this step, the patterned surface 4*a* of the negative-type silicone cast 4, on which the surface transfer of the pattern is completed as shown, is applied with an epoxy resin as a reactive curable material, and is cured by settling at room temperature for about 24 to 48 hours, so as to provide a positive-type epoxy mandrel 5 having a patterned surface 5*a*. Then, this is demolded, and the pattern of the patterned surface 5*a* is checked. If seams or other small defects exist, retouching on them is carried out, and as required, lettering is carried out.

The use of the epoxy mandrel 5 has an advantage in that it is possible to minimize concern about deformation of the pattern during demolding of a porous electroformed shell as an electrodeposited layer as described below.

Figure 1E:
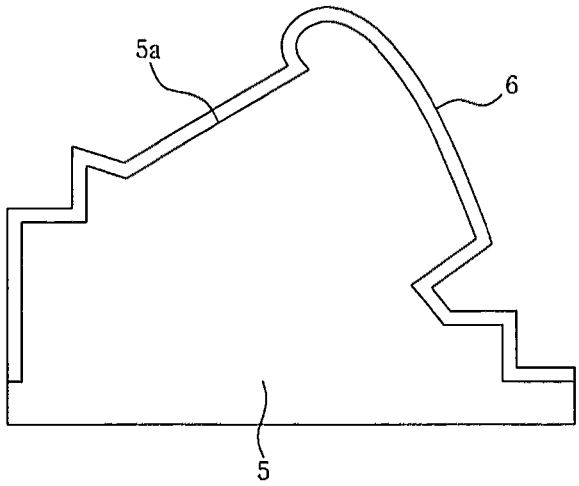

Then, as shown in FIG. 1*e*, a conductive thin film forming step is proceeded, in which the patterned surface 5*a* of the epoxy mandrel 5 is uniformly formed with a conductive thin film 6 by a silver mirror reaction, pasty silver lacquer spray, electroless plating, electroplating, or the like in such a manner that a pin hole or layer separation does not occur, and then conducting treatment is performed.

When the conductive thin film 6 is excessively thin, it is impossible to provide sufficient conductivity, and on the other hand, when it is excessively thick, the fidelity or sharpness of a three dimensional fine pattern formed on the patterned surface 5*a* of the epoxy mandrel 5 is reduced. Thus, the thickness of the conductive thin film 6 is about 1 to 30 μm, and is preferably within a range of 2 to 10 μmm, but the present invention is not limited thereto. The thickness may be changeable to some extent by various parameters, such as shape or depth of a pattern, width of a grain, physical properties required for an electroformed shell, the utilization of the film, and the like.

Figure 1F:
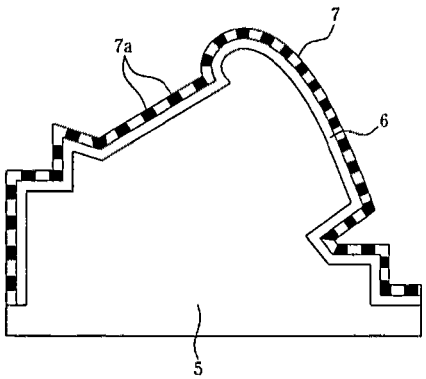

Then, a masking film attaching step shown in FIG. 1*f* is carried out, in which on the conductive thin film 6, a masking film 7 is attached.

A masking pattern 7*a* on the masking film 7 corresponds to a fine-hole forming position on an electroformed shell, as described below, and thus is designed in consideration of various conditions, such as a three dimensional shape property of the epoxy mandrel 5, a pattern property on the patterned surface 5*a*, a physical property of the electroformed shell, a physical property of a molding resin of constituting an injection molded product or its surface decorative material, a molding temperature, or the like.

Figure 2:
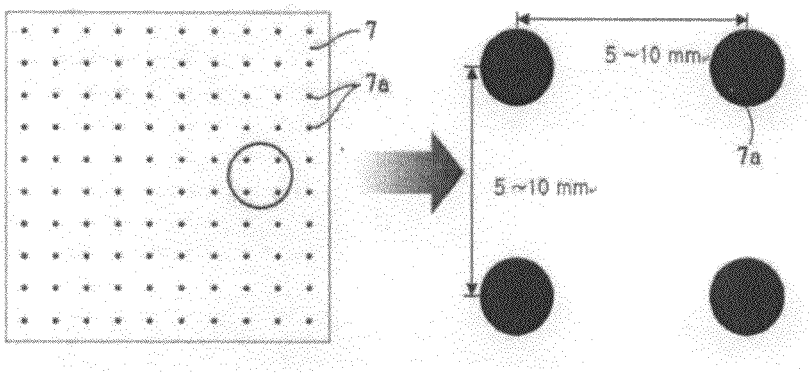
FIG. 2 is a plan view illustrating an example of a masking film to be used in the manufacturing method according to the present invention.

The simplest example of the masking film 7 is shown in FIG. 2. In the shown masking film 7, the masking patterns 7*a* are in a form of dots in non-conductive ink, in which the dots are equally spaced apart from each other and the number (density) of the dots per unit area is uniformly formed as a whole. The dot pattern 7*a* has a diameter in a range of 0.2 to 0.45 mm, preferably of 0.3 to 0.35 mm. Also, the interval between the dot patterns 7*a* is in a range of 3.5 to 10 mm, preferably of 5 to 10 mm, but the present invention is not limited thereto.

If the size of the dot pattern 7*a* is less than about 0.2 mm, there is high possibility that it cannot grow into a fine through pore at the position and may be buried in an electroforming metal through electroforming. On the other hand, if the size is greater than about 0.45 mm, an opening diameter of the fine through pore may be excessively enlarged during electroforming, by which an air vent mark may be seen on the outer surface of the molded product with the naked eye through vacuum-forming employing an electroformed shell.

Also, when the interval between the dot patterns 7*a* is less than about 3.5 mm, there is a high possibility that bubbles may stick to each other by growing during electroforming. Thus, such an interval, in some cases, may be not preferable. On the other hand, the interval is greater than about 10 mm, the distribution (density) of fine pores is excessively reduced, which may significantly lower a vacuum molding effect achieved by an electroformed shell. Thus, this interval may also be not preferable.

However, in some exceptional cases, the interval between the dot patterns 7*a* may be about less than 3.5 mm, This allows the bubbles growing through electroforming to stick to each other, thereby providing a dumbbell shaped or a bead shaped fine pore design.

Accordingly, the above described distribution of the patterns 7*a* is exemplary only. Preferably, in consideration of the outer shape of a three dimensional injection molded product, a pattern density and/or a dot diameter are locally adjusted. For example, in a relatively flat portion, the number of the patterns per unit area may be relatively small, and in a deeply curved portion, the number per unit area may be relatively large.

Also, the dot thickness of the dot patterns 7*a* is selective, but generally is within a range of about 3 to 50 μm, preferably of about 5 to 25 μm.

Meanwhile, as the masking film 7 that may be used in the manufacturing method of the present invention, any one of a wet transferring film, and a negative-type or positive-type photomask film may be used. Especially, in a case of a complicated three dimensional shape, the wet transferring film may be preferred from the standpoint of transferring efficiency, but the present invention is not limited thereto.

Figure 1G:
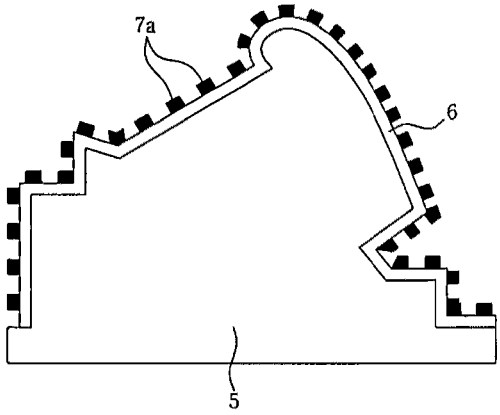

FIG. 1*g* shows a transferring step of a non-conductive masking (ink) pattern 7*a*. Herein, if the masking film 7 is a wet transferring film, the non-conductive masking pattern 7*a* is transferred by removing a water soluble substrate, such as polyvinyl alcohol (PVA), through water dissolution, and if the masking film 7 is a photomask film, the non-conductive masking pattern 7*a* is transferred by UV irradiation and development.

Herein, the portion of the conductive thin film 6 is electrodeposited with an electroforming metal during electroforming, and the portion of the non-conductive masking pattern 7*a* is not electrodeposited with an electroforming metal.

Figure 1H:
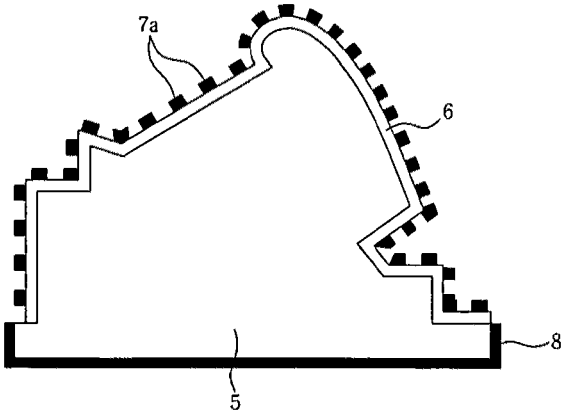

FIG. 1*h* shows a step of masking a lateral surface and an undersurface, on which a pattern is not formed, so that an electroforming metal is not electrodeposited during electroforming. The reference numeral 8 denotes a masking portion.

Figure 1I:
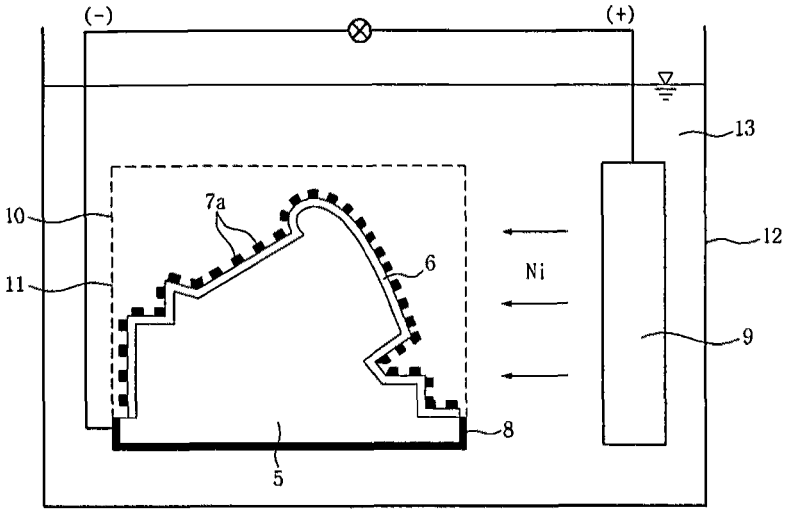
Figure 1J:
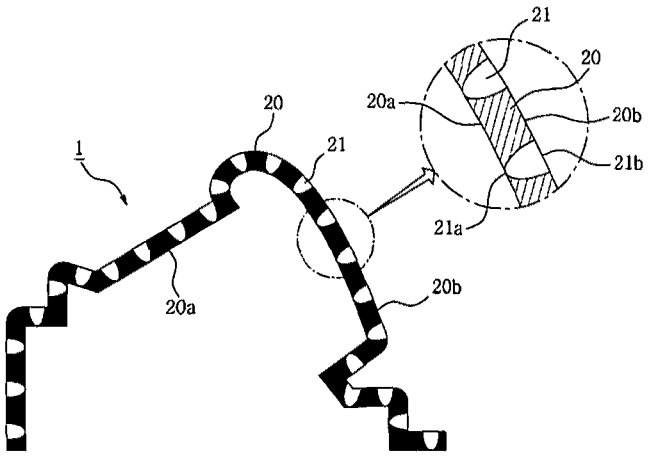

Then, FIG. 1*i* shows an electroforming step. As shown, the conductive thin film 6 of the epoxy mandrel 5, which has been subjected to conducting and non-conducting transfer processes, and has a masked lateral surface and a masked undersurface, is connected to a negative terminal of an electrical device, and a metallic electrode 9 is connected to a positive terminal. They are taken in an electroforming cell 12 containing an electroforming liquid 13, and then electroforming (electrodepositing) plating is carried out by application of DC. Then, metal ions are moved through the electroforming liquid 13, and are electrodeposited on the conductive thin film 6 on the epoxy mandrel 5 having conductivity so as to form a metal electrodeposited layer (that is, the porous electroformed shell 1 for patterning as shown in FIG. 1*j*).

In general, as the metallic electrode 9 that may be used for electroforming, Ni is most widely used. However, the metallic electrode 9 may be made of copper, brass, or the like. Also, although only one metallic electrode 9 at the right side is shown in the example, it is possible to provide a plurality of metallic electrodes at both left and right sides, or at front, rear, left, and right sides.

Meanwhile, in a case of a nickel electroforming shell, the electroforming liquid 13 may include conventional nickel sulfamate and boric acid as main components, and as required, may further include nickel chloride, or sodium lauryl sulfate as a surfactant.

Nickel electroforming is preferably carried out under relaxed conditions other than general conditions to form fine pores, because such relaxed conditions are advantageous in the control of the growth of bubbles, and the prevention of the detachment of bubbles. Specifically, nickel is precipitated from the surface of the conductive thin film 6 while an excess electric field is generated in an interface with the non-conductive pattern 7*a*, thereby generating a large amount of fine hydrogen gas bubbles. As the bubbles are entrained, the bubbles become larger and grow to some extent. Then, according to the progress of electroforming, a fine through pore (see reference numeral 21 in FIG. 1*j*) having a diameter increasing toward the outside is formed by the shape of a bubble.

Accordingly, under the relaxed conditions according to the manufacturing method of the present invention, for example, a step-by-step gradual increase in a current from 0.5 to 2.5 $A/dm^2$, or under fixed conditions, it is possible to minimize a change in physical properties of a nickel electrodeposited layer, caused by a sudden change in a current, and also to obtain a stable fine through shape.

However, such conditions are not unconditional, but selective. Thus, they are appropriately selected and determined according to a change in various conditions such as three dimensional shape properties and thickness of an electroformed shell, pattern properties, physicochemical properties of a molding resin constituting an injection molded product or its surface skin material, or the like.

Also, according to the manufacturing method of the present invention, a blocking film 10 having multiple pores 11, made of a non-electrodepositable rigid resin (such as a condensation resin of phenol and formaldehyde, e.g., Bakelite (trade name)), is preferably placed in a box form at the upper part and the front/rear/left/right side parts of the epoxy mandrel 5 to be electrodeposited, so as to prevent bubbles from detaching by the flow velocity of the electroforming liquid. This helps satisfactory generation and growth of the above described fine through pores.

The height of the blocking film 10 is preferably greater than the uppermost height of the epoxy mandrel 5 by 20~200 mm. Also, the pore 11 formed in the blocking film 10 has diameters increasing from the center to the outside in such a manner that a uniform thickness of an electroformed shell can be secured through uniform electrodeposition.

Then, FIG. 1*j* shows a mimetic cross-sectional view of the porous electroformed shell 1 for forming a negative-type pattern, demolded from the epoxy mandrel 5. From the drawing, it can be seen that the porous electroformed shell 1 for patterning including an electrodeposited layer 20 electrodeposited, in the above described electroforming step, on the conductive thin film 6 of the epoxy mandrel 5, has multiple fine pores 21 formed therein.

The electrodeposited layer 20 has a front surface (that is, an internal surface) 20*a* as a patterned surface, and a rear surface (that is, an external surface) 20*b*, and has the fine pores 21 derived from the masking pattern 7*a* of the above mentioned masking film 7.

The fine pore 21 is formed by an electroforming metal not electrodeposited to a bubble area, as hydrogen bubbles are generated, attached, grown, and developed, on the masking pattern 7*a* during electroforming. Thus, it takes a cup shape having a front-side opening 21*a* with a very small diameter, and a rear-side opening 21*b* with a relatively very large diameter.

Such a shape is important, because it allows air venting or suction to effectively occur during preforming of a molded product or a decorative skin material, and also prevents foreign substances, such as a molding resin, a dust, or the like, from blocking the fine pore 21.

The front-side opening 21*a* of the fine pore 21 has a diameter within a range of 0.02~0.35 mm, preferably of 0.05~0.15 mm, but the present invention is not limited thereto, while the rear-side opening 21*b* has a diameter within a range of 1.20~3.50 mm, preferably of 1.50~3.20 mm, but the present invention is not limited thereto.

The fine pores 21 are spaced apart from each other, and may be formed in such a manner that the density of the fine pores 21 (that is, the number of the fine pores per unit area) can be wholly uniform or locally non-uniform. Also, the diameter of the fine pores 21 may be locally different according to the morphological features of the electroformed shell 1 for patterning.

Meanwhile, the thickness of the electrodeposited layer 20 constituting the electroformed shell 1 for patterning is generally within a range of 0.15 mm to 15 mm, but may be appropriately determined within a larger range according to various parameters, such as three dimensional shape and pattern properties, physical properties required for the utilization of an electroformed shell, physicochemical properties of a molding resin constituting an injection molded product or its surface skin material, a molding temperature, or the like.

In amplification, although not shown, the masking pattern 7*a* and the conductive thin film 6 exist in a front surface (internal surface) of the porous electroformed shell 1 demolded from the epoxy mandrel 5. Thus, for example, the conductive thin film 6, such as a silver mirror film, is removed by using a mixed liquid of hydrogen peroxide and ammonia, and the masking pattern 7*a* is subjected to combustion removal or solvent removal. Then, gloss control is carried out. As required, cleaning on a rear surface (external surface) of the porous electroformed shell 1, cutting of a residue portion, grinding, gloss treatment, sand blast, and the like may be appropriately carried out.

When the porous electroformed shell 1 for patterning is made of nickel, its characteristics are in actuality the same as the physical properties of pure nickel, and are specifically described below:

thickness: equal to or less than 5 mm (selective), density: 8.908 g/cm$^3$, melting point: 1455° C., thermal expansion coefficient (25° C.): 13.4 μm/(m·K), and thermal conductivity (300K): 90.9 W (m·K).

In the manufacturing method according to the present invention, as described above, when the non-conductive pattern 7*a* to be generated and grown as the fine pore 21 is formed on the conductive thin film 6, the masking film 7 having the pre-controlled pattern 7*a* is used. Thus, it is possible to simply, economically, and efficiently carry out precise control, both as a whole or in part, on the diameter, formation position, and density of the fine pores to be formed in the three dimensional-shaped porous electroformed shell 1 according to various curved shapes of the porous electroformed shell 1, and also, the diameter, formation position, and density of the fine pores can show high reliability and constancy without a difference in the proficiency of an operator and other variables. In other words, through the porous electroformed shell 1 obtained by the manufacturing method of the present invention, it is possible to effectively provide a highly-refined, sharp, and precise texture to the external surface of a surface skin material or a plastic molded product, to be applied to one-piece molding of a high-quality surface skin material.

Also, in the above described method for manufacturing the porous electroformed shell 1 for patterning, as shown in FIGS. 1*a* to 1*j*, if a plurality of exactly the same porous electroformed shells 1 are required for mass production, a unit process of 'silicone cast-epoxy mandrel-electroforming-porous electroformed shell' may be repeated so as to obtain multiple duplicates. From such a plurality of duplicate porous electroformed shells, a required injection molded product or a decorative surface skin material can be mass-produced.

Since the masking film 7 illustrated in FIG. 2 has been already described, its additional description will be omitted. Meanwhile, FIG. 3 is a mimetic diagram of the epoxy plate 5 in a state where the epoxy plate 5 has the patterned surface 5*a* with a grain pattern, and the electroforming conductive thin film 6 formed thereon.

Figure 3:
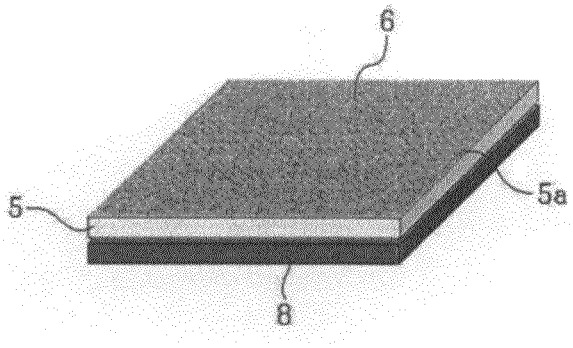
FIG. 3 is a mimetic diagram illustrating an epoxy plate in a state where the epoxy plate is formed with a grain pattern and has an electroforming conductive thin film formed thereon.

In FIG. 3, the thickness of the conductive thin film 6 is within a range of about 1 to 30 μm so that the fidelity or sharpness of the three dimensional fine pattern formed on the patterned surface 5*a* on the epoxy plate 5 cannot be lowered as described above. Also, the undersurface and the lower portion of the lateral surface, on which the electrodeposited layer is not formed, are formed with the masking portion 8.

Figure 4A:
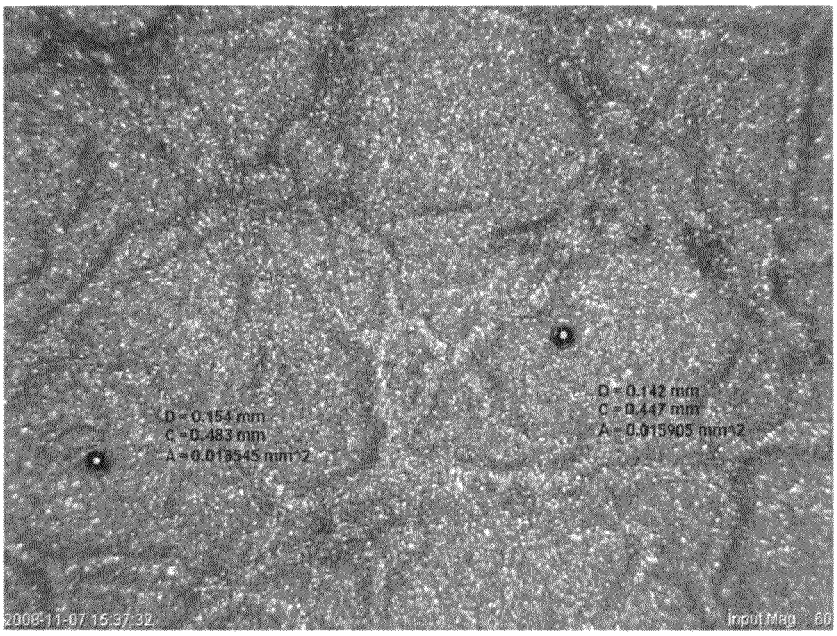
FIGS. 4*a* to 4*b* are enlarged photographs showing a front-side opening, and a rear-side opening of a fine pore formed in a patterning porous electroformed shell manufactured according to the present invention, in which the front-side opening and the rear-side opening correspond to a fine pore opening on a grain patterned surface, and another fine pore opening on a rear surface of the grain patterned surface, respectively.
Figure 4B:
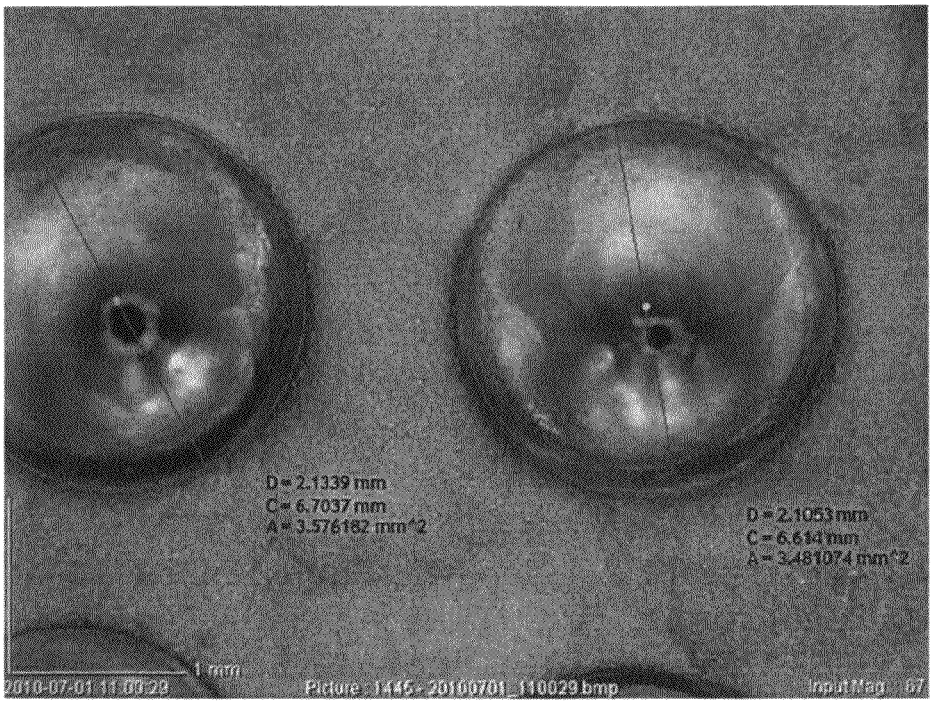

FIGS. 4*a* and 4*b* are ×60 enlarged photographs showing the front-side opening (see reference numeral 21*a* in FIG. 1*j*), and the rear-side opening (see reference numeral 21*b* in FIG. 1*j*) of the fine pores (see reference numeral 21 in FIG. 1*j*), respectively, in which the fine pores are formed on the grain patterned surface 20 of the porous (nickel) electroformed shell for patterning, obtained by the manufacturing method of the present invention.

Figure 5:
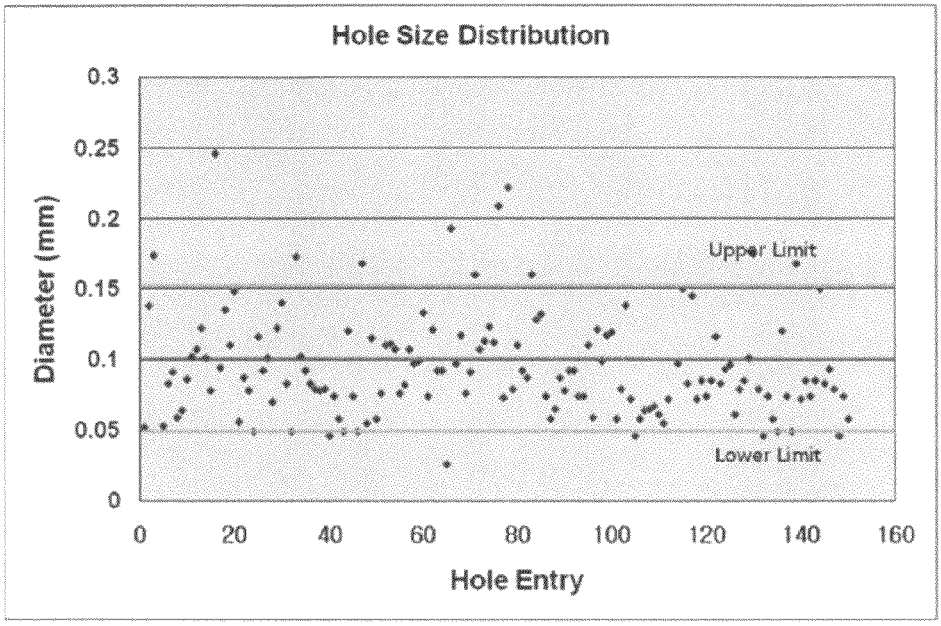
FIG. 5 is a view illustrating a distribution of front-side opening diameters of fine pores formed in a patterning porous electroformed shell manufactured according to the present invention.

FIG. 5 shows a surface diameter distribution of the front-side opening (see reference numeral 21*a* in FIGS. 1*j* and 5*a*) of the fine pores, in which from among 160 fine pores, about 149 fine pores have a front-side opening's diameter within a target range from 0.15 mm to 0.05 mm. It can be seen that it is possible to set 93% or more of fine pores within a required range.

Figure 6A:
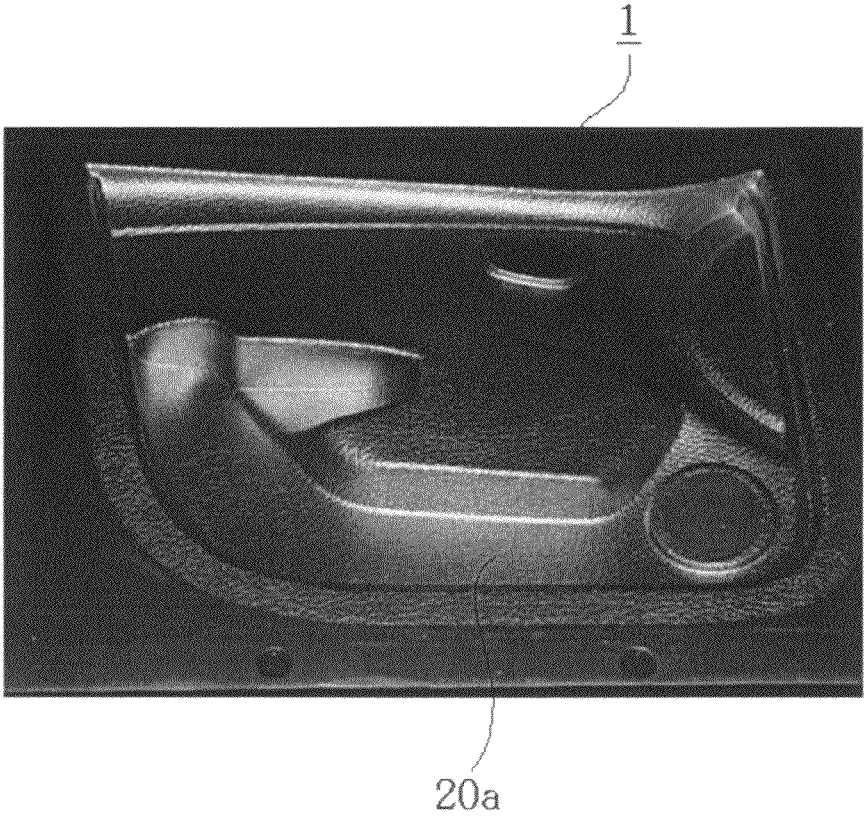
FIGS. 6*a* and 6*b* are exemplary photographs showing a grain patterned surface and its rear surface of a patterning porous electroformed shell manufactured according to the present invention, respectively.
Figure 6B:
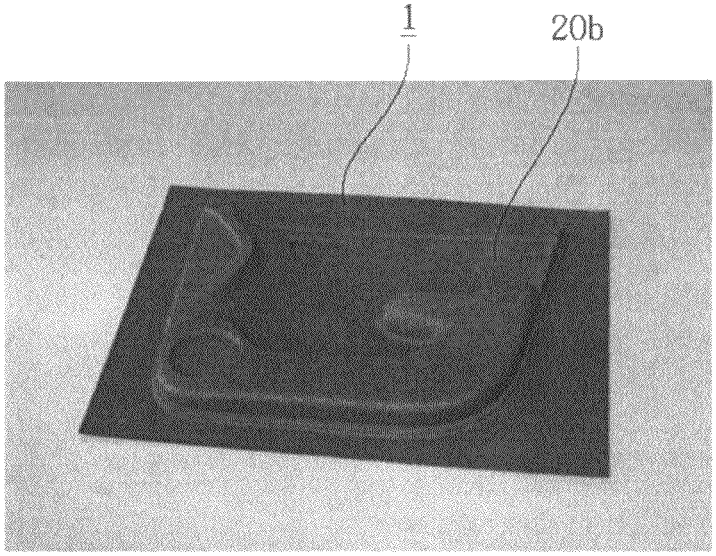

FIGS. 6*a* and 6*b* are perspective photographs showing the grain patterned surface 20*a* and its rear surface 20*b* of the porous (nickel) electroformed shell 1 for patterning in an automobile interior material, manufactured according to the present invention, respectively. Also, from FIG. 7*a*, it can be clearly seen that the grain pattern is similar to leather.

Figure 7:
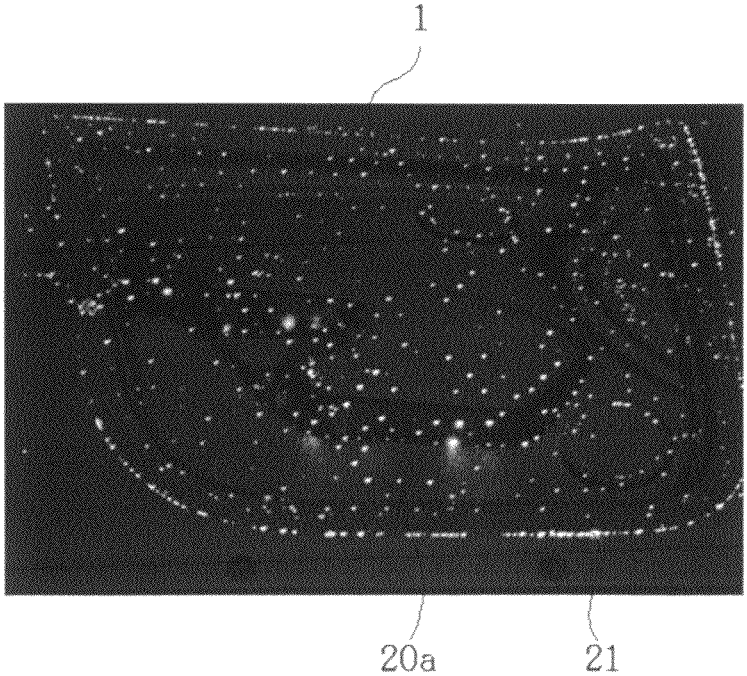
FIG. 7 is a darkroom photograph showing multiple fine pores, in which a light source is positioned at the back of the grain patterned surface of the porous electroformed shell shown in FIG. 6*a*, and thus allows the pores to be observed with the naked eye.

FIG. 7 is a darkroom photograph showing multiple fine pores, in which a light source is positioned at the back of the grain patterned surface 20*a* of the porous (nickel) electroformed shell 1 for patterning shown in FIG. 6*a*, and the pores are observed from the undersurface side with the naked eye. From FIG. 7, it is possible to directly see the multiple fine pores 21.

Figure 8A:
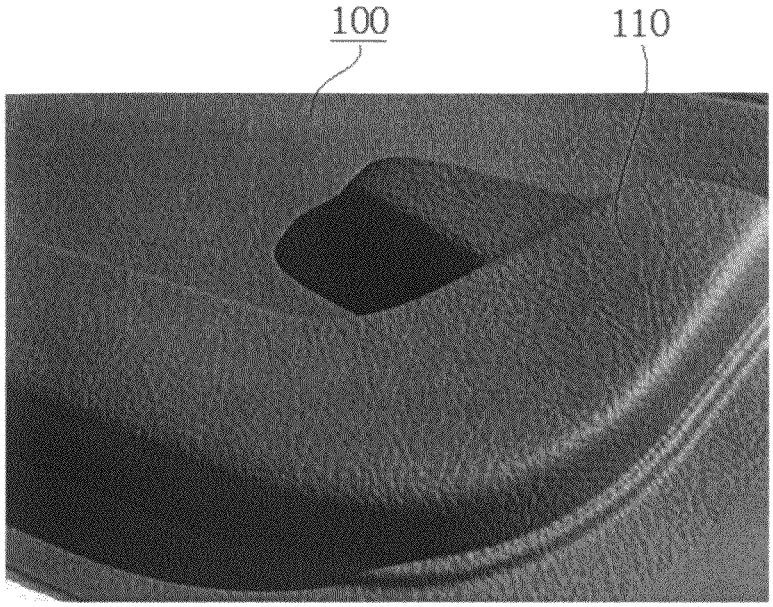
FIGS. 8*a* and 8*b* are exemplary photographs showing surface textures of a grain patterned in-mold molded product employing the porous electroformed shell shown in FIGS. 6*a* and 6*b*, respectively.
Figure 8B:
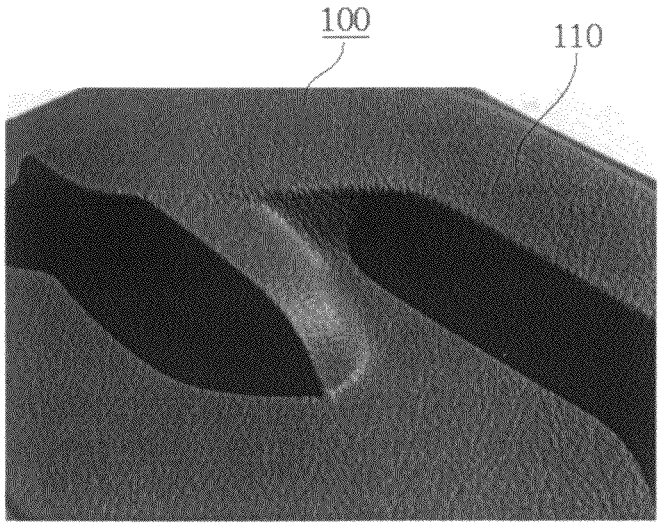
Figure 9:
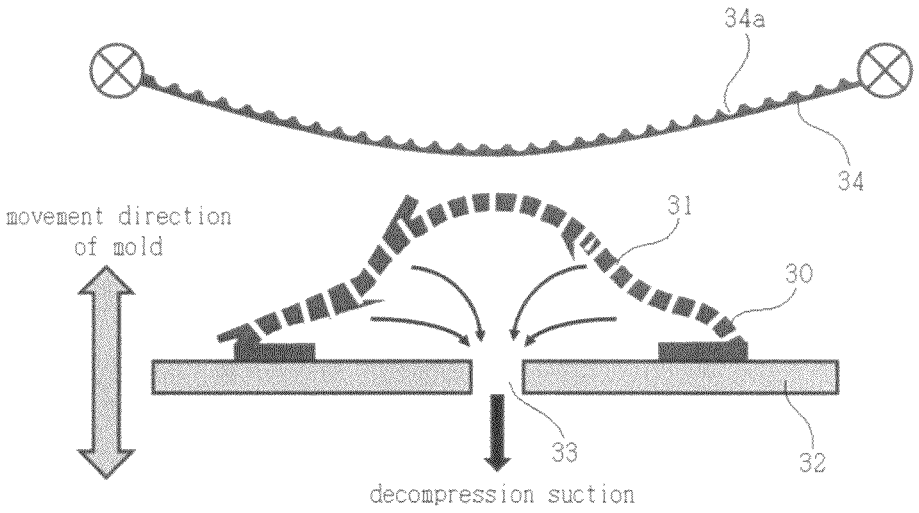
FIG. 9 is a mimetic diagram illustrating a conventional general positive type vacuum molding method for preforming a skin material as a decorative layer.
Figure 10:
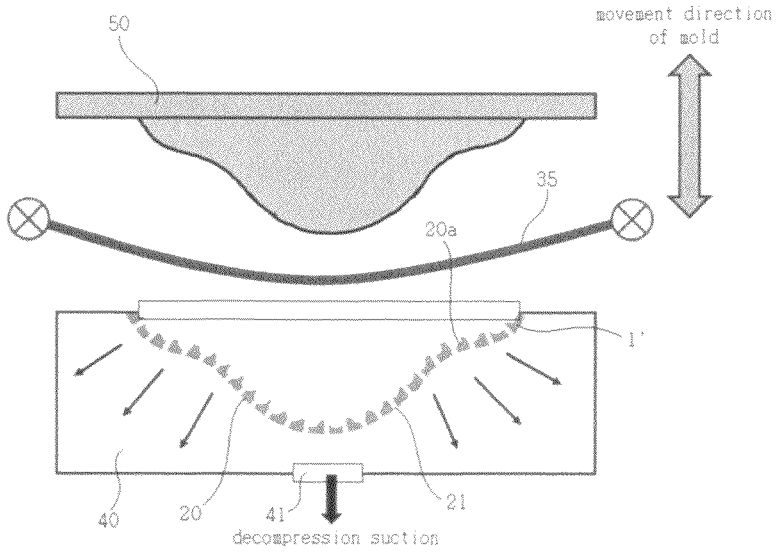
FIG. 10 is a mimetic diagram illustrating a conventional general negative type vacuum molding method for preforming a skin material as a decorative layer.

Then, FIGS. 8*a* and 8*b* are exemplary photographs showing surface textures realized on the surface decorative grain patterned in-mold plastic molded products shown in FIGS. 6*a* and 6*b*, respectively, the textures being obtained by the porous (nickel) electroformed shell 1 for patterning.

Hereinafter, the present invention will be described in more detail with reference to Examples. However, the Examples are illustrative only, and are not intended to limit the present invention.

Examples 1 to 4

Manufacture of a Porous Nickel Electroformed Test Piece

In order to manufacture a molded product having a grain patterned surface, 12 epoxy plate-type test pieces having the grain pattern as shown in FIG. 4 were prepared. Each test piece was manufactured with a size of 100 mm×100 mm×25 mm (thickness), and a porous nickel electroformed shell for patterning was manufactured in accordance with the process as illustrated in FIG. 5 as described below.

The grain patterned surface on the epoxy plate-type test piece became conductive through a silver mirror reaction.

On the surface of the silver mirror, the masking film (sheet) shown in FIG. 2 was attached and transferred with different dot sizes as noted in Table 1. After the transfer of a dot pattern, a box-shaped Bakelite blocking film having multiple pores formed therein (see reference numeral 10 in FIG. 1*i*) was provided at the upper side and the front/rear/left/right sides with a height of 25 mm upwardly from the upper surface of the test piece in order to reduce flow velocity on the electroformed surface.

Then, in an electroforming cell, nickel electroforming was carried out.

In the electroforming, a current was 0.6 A/dm$^2$ at the initial stage, and then increased to 1.5 A/dm$^2$.

The electroforming liquid contains nickel sulfamate acid of 400~450 g/l, and boric acid of 20~35 g/l, and has pH 3.5~4.5.

TABLE 1

| | dot diameter of wet transfer masking film (mm) | temperature | dot thickness |
|---|---|---|---|
| Example 1 | Φ0.25 | 30~32° C. | 9~12 μm |
| Example 2 | Φ0.35 | | |
| Example 3 | Φ0.45 | | |
| Example 4 | Φ0.55 | | |

Examples 5 to 9

Manufacture of a Porous Nickel Electroformed Test Piece

Electroforming was carried out while a current was 0.6 A/dm$^2$ at the initial stage, and then increased to 1 A/dm$_2$, and then to 1.5 A/dm$^2$.

Meanwhile, on the surface of the silver mirror of the epoxy plate, the wet transfer-type masking film was transferred with different dot sizes as noted in Table 2.

The plating solution has the same conditions as those of Examples 1 to 4, except that sulfamic acid is included in an amount of 450~500 g/l.

TABLE 2

| | dot diameter of wet transfer masking film (mm) | temperature | dot thickness |
|---|---|---|---|
| Example 5 | Φ0.3 | 30~32° C. | 9~12 μm |
| Example 6 | Φ0.35 | | |
| Example 7 | Φ0.4 | | |
| Example 8 | Φ0.5 | | |
| Example 9 | Φ0.55 | | |

Example 10

Manufacture of a Porous Nickel Electroformed Test Piece

Electroforming was carried out with a fixed current of 1.5 A/dm$^2$, and a wet transfer masking film's dot thickness of 12 to 15 μm. Other conditions were the same as those noted Table 2.

TABLE 3

| | dot diameter of wet transfer masking film (mm) | temperature | dot thickness |
|---|---|---|---|
| Example 10 | Φ0.45 | 30~32° C. | 12~17 μm |

Examples 11 and 12

Manufacture of a Porous Nickel Electroformed Test Piece

Electroforming was carried out with a fixed current of 2 A/dm$^2$. Other conditions were the same as those noted Table 2.

TABLE 4

| | dot diameter of wet transfer masking film (mm) | temperature | dot thickness |
|---|---|---|---|
| Example 11 | Φ0.35 | 30~32° C. | 12~17 μm |
| Example 12 | Φ0.35 | 40~42° C. | |

Test Examples 1 and 2

Test on a Front-Side Opening Diameter and a Rear-Side Opening Diameter of a Fine Pore in a Test Piece For a fine pore formed in each of the porous nickel electroformed test pieces obtained from Examples 1 to 12, the front-side (grain patterned) opening diameter and the rear-side opening diameter were measured, respectively. The results are noted in Tables 5 and 6.

Also, the formation ratio of fine pores was calculated, and is noted in Table 6.

TABLE 5

| Example | dot diameter of masking film (mm) | dot thickness | temperature | front-side opening diameter |
|---|---|---|---|---|
| Example 1 | Φ0.25 | 9~12 μm | 30~32° C. | 0.02~0.17 |
| Example 2 | Φ0.35 | | | 0.06~0.17 |
| Example 3 | Φ0.45 | | | 0.11~0.23 |
| Example 4 | Φ0.55 | | | 0.11~0.33 |
| Example 5 | Φ0.3 | | | 0.06~0.12 |
| Example 6 | Φ0.35 | | | 0.08~0.22 |
| Example 7 | Φ0.4 | | | 0.09~0.16 |
| Example 8 | Φ0.5 | | | 0.06~0.23 |
| Example 9 | Φ0.55 | | | 0.11~0.31 |
| Example 10 | Φ0.45 | 12~17 μm | | 0.16~0.26 |
| Example 11 | Φ0.35 | | | 0.07~0.20 |
| Example 12 | Φ0.35 | | 40~42° C. | 0.15~0.24 |

TABLE 6

| Example | dot diameter of masking film (mm) | formation ratio of fine pores | rear-side opening diameter (mm) |
|---|---|---|---|
| Example 5 | Φ0.3 | 23% | 1.53~1.72 |
| Example 6 | Φ0.35 | 38% | 1.61~1.78 |
| Example 7 | Φ0.4 | 36% | 1.44~2.08 |
| Example 8 | Φ0.5 | 72% | 1.56~1.92 |
| Example 9 | Φ0.55 | 90% | 1.59~1.78 |
| Example 10 | Φ0.45 | 58% | 2.40~2.50 |
| Example 11 | Φ0.35 | 78% | 1.91~3.11 |
| Example 12 | Φ0.35 | 80% | 1.78~2.07 |

As noted in Table 5, as a result of the test on the front-side opening diameter of fine pores in the porous nickel electroformed test pieces obtained from Examples 1 to 12, it can be seen that when the dot diameter of the masking film is within a range of 0.3 to 0.35 mm, the most preferable opening diameter was be obtained.

Meanwhile, it was determined that the test pieces obtained from Examples 1 to 4 have low fine pore formation ratios in which dots transferred from the masking film are not grown and developed into fine pores. Also, it can be seen from Table 6 that the test pieces obtained from Examples 11 and 12 can achieve the most preferable effects in the fine pore diameter and the fine pore formation ratios.

Accordingly, according to the manufacturing method of the present invention, it is possible to simply and easily achieve the precise control on the diameter and the distribution of fine pores.

Although the present invention has been described with reference to Examples and Test Examples, those skilled in the art will appreciate that various modifications, additions and substitutions are possible, without departing from the scope and spirit of the invention as disclosed in the accompanying claims.

What is claimed is:

1. A method for manufacturing a porous electroformed shell for patterning, the method comprising the steps of:

providing an epoxy mandrel having a patterned surface;

forming a conductive thin film having an upper surface on said patterned surface of said epoxy mandrel, and causing said patterned surface of said epoxy mandrel to be conductive;

providing a wet-transfer masking film having a plurality of spaced-apart non-conducting ink dots forming a non-conductive masking pattern, wherein said dots have a diameter within a range of 0.2 to 0.45 mm and an interval between said dots is within a range of 3.5 to 10 mm;

transferring said plurality of spaced-apart non-conducting ink dots of said non-conductive masking pattern onto said upper surface of said conductive thin film by using said wet-transfer masking film;

removing said wet-transfer masking film through water dissolution, with said non-conducting ink dots of said non-conductive masking pattern remaining on said upper surface of said conductive thin film, wherein said non-conductive masking pattern corresponds to a position of a fine pore;

electrodepositing an electroforming metal directly atop said upper surface of said conductive thin film to form a single electroformed layer, while generating and growing the fine pore in said electroformed layer solely at a position of said non-conductive masking pattern transferred to said upper surface of said conductive thin film; and separating said electroformed layer having said fine pore from said epoxy mandrel, wherein said fine pore of said porous electroformed shell has a cup shape having a front-side opening diameter which is within a range of 0.02 to 0.35 mm, and a rear-side opening diameter which is within a range of 1.20 to 3.50 mm.

2. The method as claimed in claim 1, wherein:

said masking pattern is transferred in such a manner that said dots are spaced apart from each other, and a dot density defined by a number of the dots per unit area is a member selected from the group consisting of wholly uniform and locally non-uniform.

3. The method as claimed in claim 2, wherein:

a thickness of said dots is within a range of 5 to 25 μm.

4. The method as claimed in claim 1, wherein:

said patterned surface of said epoxy mandrel is formed as a grain pattern for leather.

5. The method as claimed in claim 1, wherein:

said conductive thin film is formed by a member selected from the group consisting of a silver mirror reaction, pasty silver lacquer spray, electroless plating, and electroplating.

6. The method as claimed in claim 1, wherein:

said electroformed layer is made of a member selected from the group consisting of nickel and copper.

7. The method as claimed in claim 1, wherein:

said porous electroformed shell has a thickness within a range of 0.15 to 15 mm.

8. The method as claimed in claim 1, wherein:

after said separating step, a conductive thin film and masking pattern removing step is further carried out.

9. The method as claimed in claim 1, wherein:

said epoxy mandrel is molded from a silicone cast.

10. The method as claimed in claim 9, wherein:

said silicone cast is molded from a member selected from the group consisting of a leather wrapping model and a pattern forming light metal model.

11. The method as claimed in claim 1, wherein:

after said separating step, carrying out a member selected from the group consisting of cleaning on an external surface of said porous electroformed shell, cutting of a residue portion, grinding, gloss and matte treatment, and sand blast.

* * * * *